US010992054B2

(12) United States Patent
Xiao et al.

(10) Patent No.: US 10,992,054 B2
(45) **Date of Patent: *Apr. 27, 2021**

(54) ARRAY ANTENNA SYSTEM

(71) Applicant: Huawei Technologies Co., Ltd., Shenzhen (CN)

(72) Inventors: Weihong Xiao, Xi'an (CN); He Cui, Dongguan (CN); Kunpeng Wang, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/752,204

(22) Filed: Jan. 24, 2020

(65) Prior Publication Data

US 2020/0235489 A1 Jul. 23, 2020

Related U.S. Application Data

(63) Continuation of application No. 16/023,192, filed on Jun. 29, 2018, now Pat. No. 10,553,958, which is a (Continued)

(51) Int. Cl.

| | |
|---|---|
| ***H01Q 21/00*** | (2006.01) |
| ***H01Q 1/24*** | (2006.01) |
| ***H01Q 21/08*** | (2006.01) |
| ***H01Q 1/38*** | (2006.01) |
| ***H01Q 21/22*** | (2006.01) |
| *H01Q 23/00* | (2006.01) |

(Continued)

(52) U.S. Cl.

CPC ..... *H01Q 21/0075* (2013.01); *H01Q 1/246* (2013.01); *H01Q 1/38* (2013.01); (Continued)

(58) Field of Classification Search

CPC .... H01Q 21/0075; H01Q 21/22; H01Q 21/08; H01Q 1/38; H01Q 1/246; H01Q 23/00; H01Q 19/10; H01Q 1/48

See application file for complete search history.

(56) References Cited

U.S. PATENT DOCUMENTS 10,553,958 B2 * 2/2020 Xiao ..... H01Q 21/08
2002/0180644 A1 12/2002 Carson et al.
(Continued)

FOREIGN PATENT DOCUMENTS

CN 2758997 Y 2/2006
CN 201975489 U 9/2011
(Continued)

OTHER PUBLICATIONS

Machine Translation and Abstract of Chinese Publication No. CN103066381, Apr. 24, 2013, 11 pages.
(Continued)

*Primary Examiner* — Dameon E Levi
*Assistant Examiner* — David E Lotter
(74) *Attorney, Agent, or Firm* — Conley Rose, P.C.

(57) ABSTRACT

The embodiments of this disclosure disclose an array antenna system. The array antenna system includes M antenna radiation units, a strip line feed system, a strip line ground plane, and a strip line cavity; the strip line feed system includes a phase shift circuit and N first printed circuit boards PCBs configured to implement a power allocation function and/or a phase compensation function; the phase shift circuit is located in the strip line cavity. P first PCBs are located on an outer surface of the strip line cavity; all or some of the M antenna radiation units are connected to signal planes of the N first PCBs, and the signal planes of the N first PCBs are in a radio frequency connection to the phase shift circuit by using probes; and ground planes of the N first PCBs are in a radio frequency connection to the strip line ground plane.

20 Claims, 4 Drawing Sheets

Related U.S. Application Data continuation of application No. PCT/CN2015/099762, filed on Dec. 30, 2015.

(51) Int. Cl.
*H01Q 1/48* (2006.01)
*H01Q 19/10* (2006.01)

(52) U.S. Cl.
CPC ..... *H01Q 21/08* (2013.01); *H01Q 21/22* (2013.01); *H01Q 1/48* (2013.01); *H01Q 19/10* (2013.01); *H01Q 23/00* (2013.01)

(56) References Cited

U.S. PATENT DOCUMENTS

| | | | |
|---|---|---|---|
| 2015/0155609 | A1 | 6/2015 | Fang |
| 2015/0263429 | A1 | 9/2015 | Vahidpour et al. |
| 2017/0358865 | A1 | 12/2017 | Sledkov et al. |

FOREIGN PATENT DOCUMENTS

| | | | |
|---|---|---|---|
| CN | 103066381 | A | 4/2013 |
| CN | 103975485 | A | 8/2014 |
| CN | 104466426 | A | 3/2015 |
| CN | 105140600 | A | 12/2015 |
| KR | 100780328 | B1 | 11/2007 |
| WO | 2009023551 | A1 | 2/2009 |
| WO | 2009132358 | A1 | 10/2009 |

OTHER PUBLICATIONS

Foreign Communication From a Counterpart Application, Chinese Application No. 201580085623.6, Chinese Office Action dated Sep. 30, 2019, 6 pages.

* cited by examiner

ARRAY ANTENNA SYSTEM

CROSS-REFERENCE TO RELATED APPLICATIONS

This application is a continuation of U.S. application Ser. No. 16/023,192, filed on Jun. 29, 2018, which is a continuation of International Application No. PCT/CN2015/099762, filed on Dec. 30, 2015. The afore-mentioned patent applications are hereby incorporated by reference in their entireties.

TECHNICAL FIELD

The present disclosure relates to the field of communications technologies, and in particular, to an array antenna system.

BACKGROUND

An array antenna system is an energy conversion apparatus in a mobile communications system. The array antenna system may convert an electromagnetic wave signal transmitted by a mobile station into an electrical signal for processing by a base station; and may convert an electrical signal transmitted by the base station into an electromagnetic wave signal for random receiving by the mobile station. In this way, bidirectional communication of a communications system is implemented.

An existing array antenna system includes M antenna radiation units, a strip line feed system, and a strip line cavity. The strip line feed system is located in the strip line cavity, and the strip line feed system includes a phase shift circuit, a power allocation circuit, and a phase compensation circuit. An output end of the phase shift circuit is in a radio frequency connection to an input end of the power allocation circuit, an output end of the power allocation circuit is in a radio frequency connection to an input end of the phase compensation circuit, and an output end of the phase compensation circuit is connected to the M antenna radiation units. A radio frequency connection includes a direct connection or a coupling connection.

In an implementation process of this disclosure, the prior art has the following disadvantages:

As a quantity of antenna radiation units increases, the power allocation circuit and the phase compensation circuit are increasingly complex. Consequently, the strip line feed system occupies larger cavity space, and it is difficult for existing cavity space to accommodate the strip line feed system.

SUMMARY

To resolve a prior-art problem, the embodiments of this disclosure provide an array antenna system. The technical solutions are as follows:

According to a first aspect, an embodiment of this disclosure provides an array antenna system, where the array antenna system includes M antenna radiation units, a strip line feed system, a strip line ground plane, and a strip line cavity, the strip line feed system includes a phase shift circuit and N first printed circuit boards PCBs configured to implement a power allocation function and/or a phase compensation function, M is an integer greater than 1, $1 \leq N \leq M$, and N is an integer;

the phase shift circuit is located in the strip line cavity, P first PCBs are located on an outer surface of the strip line cavity, and P is an integer greater than 1 and less than or equal to N;

all or some of the M antenna radiation units are connected to signal planes of the N first PCBs, and the signal planes of the N first PCBs are in a radio frequency connection to the phase shift circuit by using probes; and ground planes of the N first PCBs are in a radio frequency connection to the strip line ground plane.

In this embodiment of this disclosure, some or all of the first PCBs are disposed on the outer surface of the strip line cavity, so that space in the strip line cavity is saved. Therefore, an existing strip line cavity can be applicable to a large quantity of antenna radiation units.

With reference to the first aspect, in a first possible implementation of the first aspect, the phase shift circuit is integrated into a second PCB or a sheet metal strip line.

In this embodiment of this disclosure, the phase shift circuit is also configured as a PCB, or the phase shift circuit is integrated into a sheet metal strip line, so that more space in the strip line cavity can be saved.

With reference to the first aspect, in a second possible implementation of the first aspect, a length of each of the N first PCBs is greater than or equal to or less than a length of the strip line cavity.

In this embodiment of this disclosure, a length of a first PCB may be set to be greater than, equal to, or less than the length of the strip line cavity. Therefore, no limitation is imposed on the length of the first PCB, and a PCB with any length can be used, so that flexibility of the first PCB can be improved.

With reference to the first aspect, in a third possible implementation of the first aspect, one or more of the M antenna radiation units are connected to a signal plane of one first PCB.

In this embodiment of this disclosure, one antenna radiation unit may correspond to one first PCB, or a plurality of antenna radiation units share one first PCB, so that the antenna radiation units can be arranged more flexibly.

With reference to the first aspect, in a fourth possible implementation of the first aspect, reflective surfaces of the M antenna radiation units are the strip line ground plane and/or an outer surface of the strip line cavity.

In this embodiment of this disclosure, the strip line ground plane is configured as a reflective surface of an antenna radiation unit, or the outer surface of the strip line cavity is configured to have a reflection function. The outer surface of the strip line cavity is configured as a reflective surface of an antenna radiation unit, and therefore there is no need to independently dispose a reflective surface on the outer surface of the strip line cavity, so that the array antenna system can be simplified.

With reference to the first aspect, in a fifth possible implementation of the first aspect, the M antenna radiation units form one or more linear array antenna systems.

In this embodiment of this disclosure, the M antenna radiation units may form one linear array antenna system, or may form one planar array antenna system, so that linear array antenna commonality can be improved.

With reference to the fifth possible implementation of the first aspect, in a sixth possible implementation of the first aspect, if the M antenna radiation units form a plurality of linear array antenna systems, the array antenna system includes a plurality of strip line cavities, each of the plurality of linear array antenna systems corresponds to one strip line cavity, and upper surfaces of strip line cavities corresponding to two adjacent linear array antenna systems in the plurality of linear array antenna systems are continuous or separated.

In this embodiment of this disclosure, if the upper surfaces of the strip line cavities corresponding to the two adjacent linear array antenna systems are set to be continuous, space occupied by the array antenna system can be reduced; or if the upper surfaces of the strip line cavities corresponding to the two adjacent linear array antenna systems are set to be separated, flexibility of the array antenna system can be improved.

With reference to the first aspect, in a seventh possible implementation of the first aspect, the M antenna radiation units include antenna radiation units at different frequency bands.

In this embodiment of this disclosure, the antenna radiation units at different frequency bands may transmit electromagnetic waves with different frequency bands, so that working efficiency of an antenna radiation unit can be improved.

With reference to the first aspect, in an eighth possible implementation of the first aspect, the ground planes of the N first PCBs are the strip line ground plane.

In this embodiment of this disclosure, the ground planes of the N first PCBs are configured as the strip line ground plane, and therefore there is no need to independently dispose the ground planes for the N first PCBs, so that the array antenna system is further simplified.

A beneficial effect of the technical solutions provided in the embodiments of this disclosure is as follows: Some or all of the first PCBs are disposed on the outer surface of the strip line cavity, so that space in the strip line cavity is saved. Therefore, an existing strip line cavity can be applicable to a large quantity of antenna radiation units.

DESCRIPTION OF EMBODIMENTS

To make the objectives, technical solutions, and advantages of this disclosure clearer, the following further describes the embodiments of this disclosure in detail with reference to the accompanying drawings.

Figure 1:
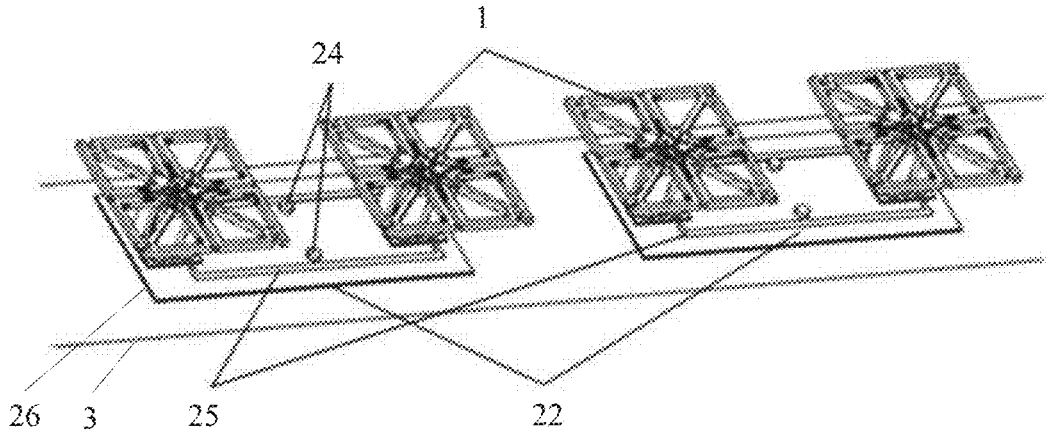
FIG. 1 is a top view of an array antenna system according to an embodiment of this disclosure.
Figure 2:
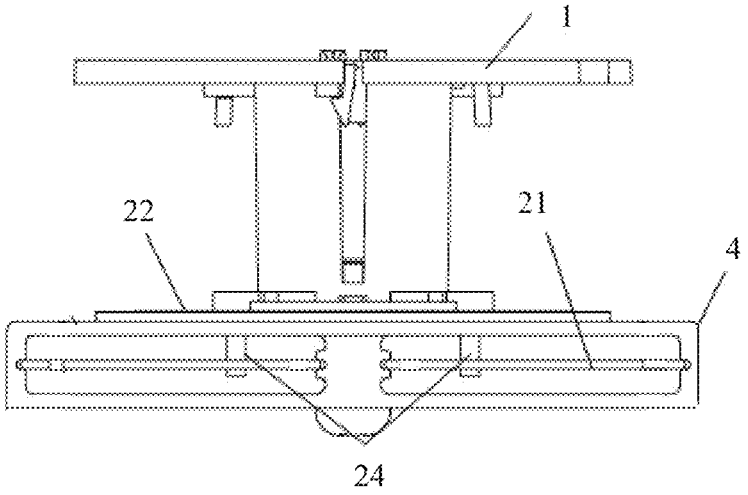
FIG. 2 is a cross-sectional view of another array antenna system according to an embodiment of this disclosure.

An embodiment of this disclosure provides an array antenna system. Referring to FIG. 1 and FIG. 2, the array antenna system includes M antenna radiation units 1, a strip line feed system 2, a strip line ground plane 3, and a strip line cavity 4.

The strip line feed system 2 includes a phase shift circuit 21 and N first PCBs (Printed Circuit Board) 22 configured to implement a power allocation function and/or a phase compensation function, M is an integer greater than 1, $1 \leq N \leq M$, and N is an integer.

The phase shift circuit 21 is located in the strip line cavity 4, P first PCBs 22 are located on an outer surface of the strip line cavity 4, and (N−P) first PCBs 22 are located in the strip line cavity 4, where P is an integer greater than 1 and less than or equal to N. All or some of the M antenna radiation units 1 are connected to signal planes of the N first PCBs 22, the signal planes of the N first PCBs 22 are in a radio frequency connection to the phase shift circuit 21 by using probes 24, and ground planes 26 of the N first PCBs 22 are in a radio frequency connection to the strip line ground plane 3.

In this embodiment of this disclosure, some or all of the first PCBs 22 are disposed on the outer surface of the strip line cavity 4, so that space in the strip line cavity 4 is saved. Therefore, an existing strip line cavity 4 can be applicable to a large quantity of antenna radiation units 1.

Preferably, to save more space in the strip line cavity 4, all the first PCBs 22 can be disposed on the outer surface of the strip line cavity 4. The outer surface may be an upper surface or a side.

The strip line feed system 2 is configured to: receive an electromagnetic wave signal transmitted by a mobile station; perform phase shift, power allocation, and phase compensation processing on the electromagnetic wave signal, to obtain a processed electromagnetic wave signal; and transmit the processed electromagnetic wave signal to the M antenna radiation units 1. The M antenna radiation units 1 are configured to: receive the processed electromagnetic wave signal transmitted by the strip line feed system 2; convert the processed electromagnetic wave signal into an electrical signal; and transmit the electrical signal for processing by a base station.

Alternatively, the M antenna radiation units 1 are configured to: receive an electrical signal transmitted by a base station; convert the electrical signal into an electromagnetic wave signal; and transmit the electromagnetic wave signal to the strip line feed system 2. The strip line feed system 2 is configured to: receive the electromagnetic wave signal transmitted by the M antenna radiation units 1; perform phase shift, power allocation, and phase compensation processing on the electromagnetic wave signal, to obtain a processed electromagnetic wave signal; and transmit the processed electromagnetic wave signal for random receiving by a mobile station.

When a first PCB 22 is configured to implement a power allocation function, the first PCB 22 is a PCB integrating a power allocation circuit. In this case, the phase shift circuit 21 is configured to implement phase shift and phase compensation functions; or the phase shift circuit 21 is configured to implement only a phase shift function, and the strip line feed system 2 further includes a third PCB configured to implement a phase compensation function. In this case, the third PCB is a PCB integrating a phase compensation circuit.

The third PCB may be located in the strip line cavity 4, or may be located outside the strip line cavity 4. In addition, the M antenna radiation units 1 are connected to a signal plane of the third PCB. The signal plane of the third PCB is in a radio frequency connection to a signal plane of the first PCB 22 by using the probe 24, the signal plane of the first PCB 22 is in a radio frequency connection to the phase shift circuit 21 by using the probe 24, and a ground plane 26 of the first PCB 22 and a ground plane of the third PCB are in a radio frequency connection to the strip line ground plane 3.

When a first PCB 22 is configured to implement a phase compensation function, the first PCB 22 is a PCB integrating a phase compensation circuit. In this case, the phase shift circuit 21 is configured to implement phase shift and power allocation functions; or the phase shift circuit 21 is configured to implement only a phase shift function, and the strip line feed system 2 further includes a fourth PCB configured to implement a power allocation function. In this case, the fourth PCB is a PCB integrating a power allocation circuit.

The fourth PCB may be located in the strip line cavity 4, or may be located outside the strip line cavity 4. In addition, the M antenna radiation units 1 are connected to a signal plane of the first PCB 22. The signal plane of the first PCB 22 is in a radio frequency connection to a signal plane of the fourth PCB by using the probe 24, the signal plane of the fourth PCB is in a radio frequency connection to the phase shift circuit 21 by using the probe 24, and a ground plane 26 of the first PCB 22 and a ground plane of the fourth PCB are in a radio frequency connection to the strip line ground plane 3.

When a first PCB 22 is configured to implement power allocation and phase compensation functions, the first PCB 22 is a PCB integrating a power allocation circuit and a phase compensation circuit, and an output end of the power allocation circuit is in a radio frequency connection to an input end of the phase compensation circuit.

It should be noted that both the power allocation circuit and the phase compensation circuit may be multiple-input multiple-output circuits, or one-input one-output circuits.

To save more space in the strip line cavity 4, the phase shift circuit 21 may be integrated into a second PCB 23 or a sheet metal strip line.

It should be noted that the strip line feed system 2 may include one phase shift circuit 21, or may include a plurality of phase shift circuits 21. If the strip line feed system 2 includes one phase shift circuit 21, the phase shift circuit 21 includes N output ports, and one output port is connected to one first PCB 22; or if the strip line feed system 2 includes a plurality of phase shift circuits 21, the plurality of phase shift circuits 21 include N output ports in total, and one output port is connected to one first PCB 22.

Further, in this embodiment of this disclosure, to improve flexibility of the first PCB 22, a length of the first PCB 22 may be not limited. In this case, a length of each of the N first PCBs 22 is greater than or equal to or less than a length of the strip line cavity 4. Certainly, lengths of the first PCBs 22 may be the same, or may be different.

When a total length of the N first PCBs 22 is less than the length of the strip line cavity 4, the N first PCBs 22 may be successively installed on one outer surface of the strip line cavity 4. For example, the N first PCBs 22 are successively installed on an upper surface of the strip line cavity 4 in a connected manner.

When a total length of the N first PCBs 22 is greater than the length of the strip line cavity 4, the N first PCBs 22 may be installed on one outer surface of the strip line cavity 4 in an overlapped manner, or may be successively installed on a plurality of outer surfaces of the strip line cavity 4. For example, when N=4, two first PCBs 22 may be installed on an upper surface of the strip line cavity 4, and two first PCBs 22 may be installed on a side of the strip line.

Further, if the length of the first PCB 22 is greater than a preset length, that is, when the first PCB 22 is relatively long, a plurality of antenna radiation units 1 may be connected to a signal plane of the first PCB 22. On the contrary, if the length of the first PCB 22 is less than a preset length, that is, when the first PCB 22 is relatively short, one antenna radiation unit 1 may be connected to a signal plane of the first PCB 22. That is, one or more of the M antenna radiation units 1 are connected to a signal plane of one first PCB 22.

The preset length may be set and modified according to the length of the strip line cavity 4. No specific limitation is imposed on the preset length in this embodiment of this disclosure. For example, the preset length may be ⅓ of the length of the strip line cavity 4.

For example, when N=3. M=6, and lengths of three first PCBs 22 are the same, and are equal to ⅓ of the length of the strip line cavity 4 each, the three first PCBs 22 are successively installed on the upper surface of the strip line cavity 4 and do not overlap. Two of six antenna radiation units 1 are connected to one first PCB 22.

Further, reflective surfaces 11 of the M antenna radiation units 1 are the strip line ground plane 3 and/or an outer surface of the strip line cavity 4, and the outer surface of the strip line cavity 4 has a reflection function. That is, the reflective surfaces 11 of the M antenna radiation units 1 may be the strip line ground plane 3, or may be the outer surface of the strip line cavity 4; or reflective surfaces 11 of some of the M antenna radiation units 1 are the strip line ground plane 3, and reflective surfaces 11 of some antenna radiation units are the outer surface of the strip line cavity 4. Alternatively, one part of a reflective surface 11 of one antenna radiation unit 1 may be the strip line ground plane 3, and the other part of the reflective surface 11 may be the outer surface of the strip line cavity 4.

It should be noted that the strip line ground plane 3 is configured as a reflective surface 11 of an antenna radiation unit 1, or the outer surface of the strip line cavity 4 is configured as a sheet metal strip line with a reflection function. The outer surface of the strip line cavity 4 is configured as a reflective surface 11 of an antenna radiation unit 1, and therefore there is no need to independently dispose a reflective surface 11 on the outer surface of the strip line cavity 4, so that the array antenna system is simplified.

Figure 3:
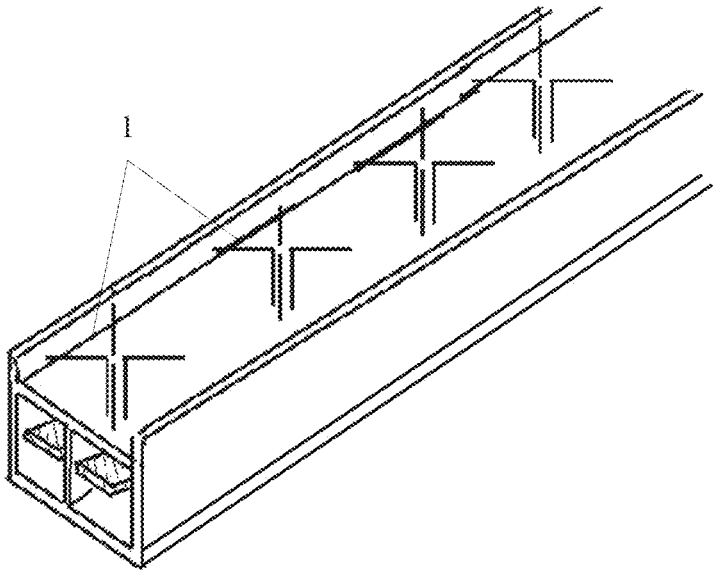
FIG. 3 is a top view of a linear array antenna system according to an embodiment of this disclosure.
Figure 4:
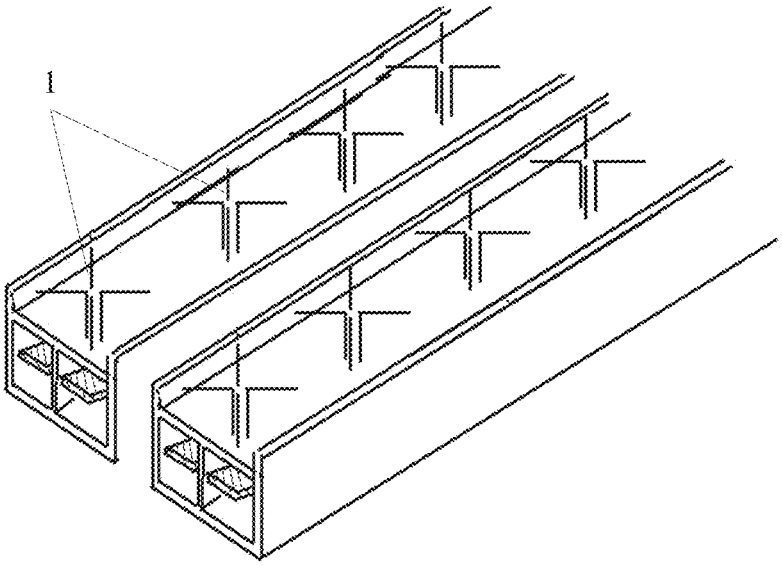
FIG. 4 is a top view of a planar array antenna system according to an embodiment of this disclosure.
Figure 5:
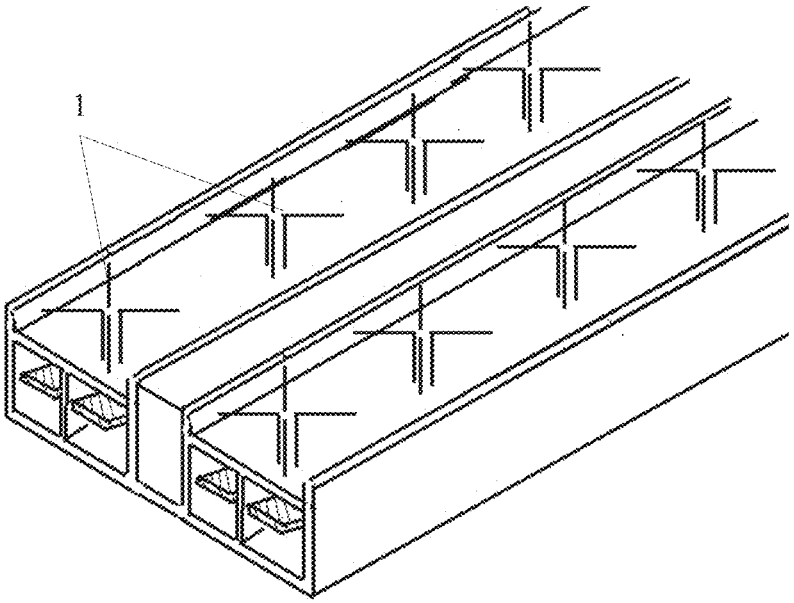
FIG. 5 is a top view of another planar array antenna system according to an embodiment of this disclosure.

Further, the M antenna radiation units 1 may form one linear array antenna system, or the M antenna radiation units 1 may form one planar array antenna system. If the M antenna radiation units 1 form one linear array antenna system, the M antenna radiation units 1 are located on a same straight line. Referring to FIG. 3, if the M antenna radiation units 1 form one planar array antenna system, that is, if the M antenna radiation units 1 form a plurality of linear array antenna systems, the array antenna system includes a plurality of strip line cavities 4, and each of the plurality of linear array antenna systems corresponds to one strip line cavity 4, and upper surfaces of strip line cavities 4 corresponding to two adjacent linear array antenna systems in the plurality of linear array antenna systems are continuous or separated. For example, referring to FIG. 4, upper surfaces of strip line cavities 4 corresponding to two adjacent linear array antenna systems are separated. For example, referring to FIG. 5, upper surfaces of strip line cavities 4 corresponding to two adjacent array antenna systems are continuous.

Further, the M antenna radiation units 1 include antenna radiation units 1 at different frequency bands. That is, the M antenna radiation units 1 include antenna radiation units 1 transmitting at least two frequency bands.

Figure 6:
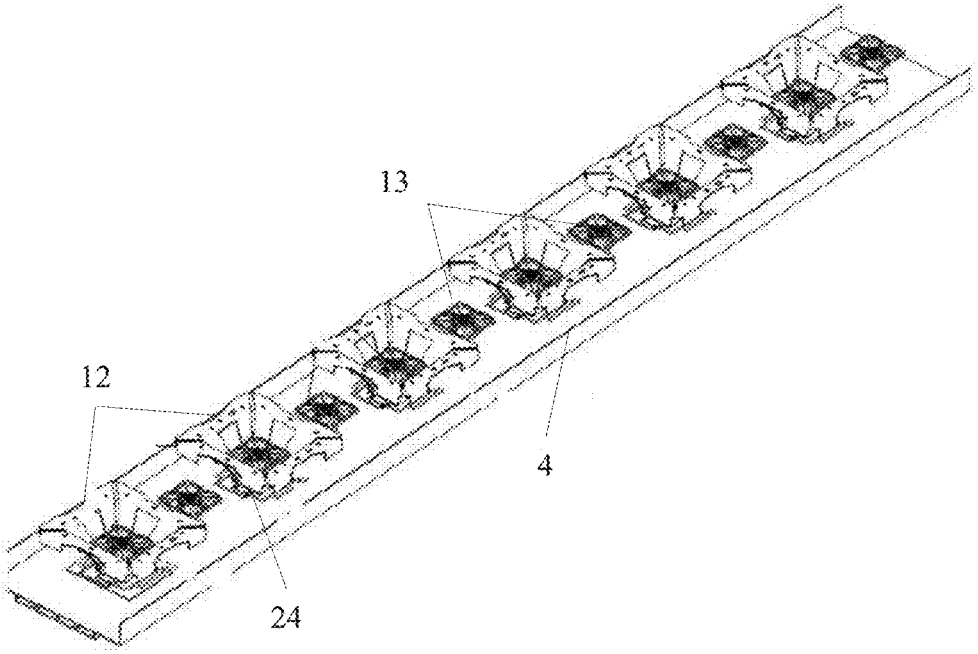
FIG. 6 is a top view of another array antenna system according to an embodiment of this disclosure.

For example, referring to FIG. 6, the M antenna radiation units 1 include some antenna radiation units 12 transmitting an electromagnetic wave with a first frequency band and some antenna radiation units 13 transmitting an electromagnetic wave with a second frequency band. In addition, a quantity of the antenna radiation units 12 transmitting an electromagnetic wave with a first frequency band may be equal or unequal to a quantity of the antenna radiation units 13 transmitting an electromagnetic wave with a second frequency band.

Figure 7:
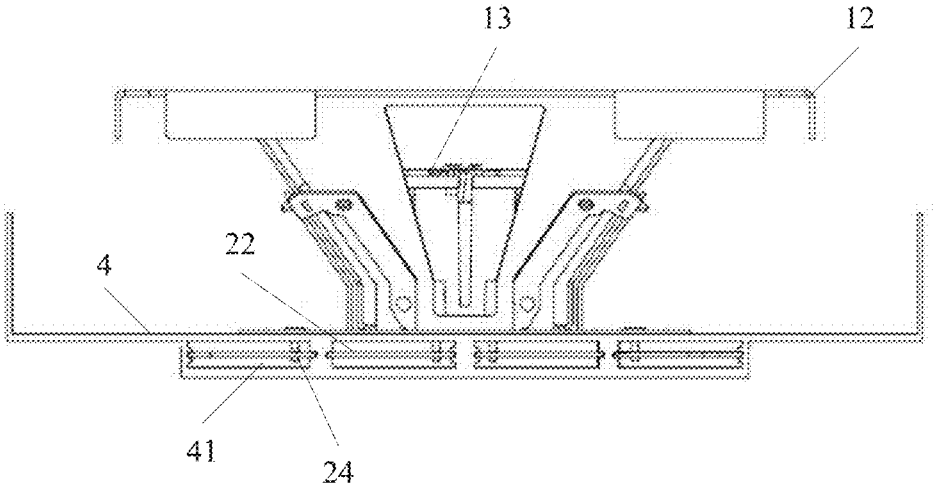
FIG. 7 is a cross-sectional view of another array antenna system according to an embodiment of this disclosure.

Referring to FIG. 7, it should be noted that when the M antenna radiation units 1 include some antenna radiation units 12 transmitting an electromagnetic wave with a first frequency band and some antenna radiation units 13 transmitting an electromagnetic wave with a second frequency band, the strip line cavity 4 includes four sub-cavities 41, the antenna radiation units 12 transmitting an electromagnetic wave with a first frequency band correspond to two sub-cavities 41, and the antenna radiation units 13 transmitting an electromagnetic wave with a second frequency band correspond to two sub-cavities 41.

Further, to simplify a structure of the array antenna system, the ground plane 26 of the first PCB 22 may be integrated with the strip line ground plane 3, that is, ground planes 26 of the N first PCBs 22 are the strip line ground plane 3.

In this embodiment of this disclosure, some or all of the first PCBs 22 are disposed on the outer surface of the strip line cavity 4, so that space in the strip line cavity 4 is saved. Therefore, an existing strip line cavity 4 can be applicable to a large quantity of antenna radiation units 1.

A person of ordinary skill in the art may understand that all or some of the steps of the embodiments may be implemented by hardware or a program instructing related hardware. The program may be stored in a computer-readable storage medium. The storage medium may include: a read-only memory, a magnetic disk, or an optical disc.

The foregoing descriptions are merely embodiments of this disclosure, but are not intended to limit this disclosure. Any modification, equivalent replacement, and improvement made without departing from the spirit and principle of this disclosure shall fall within the protection scope of this disclosure.

The invention claimed is:

1. A base station, comprising:

an array antenna system, wherein the array antenna system comprises:

M antenna radiation units; and a strip line feed system, wherein the strip line feed system comprises a strip line cavity, a phase shift circuit and N first printed circuit boards (PCBs) configured to implement a power allocation function and/or a phase compensation function, wherein M is an integer greater than 1, wherein N is an integer greater than or equal to 1, and wherein N≤M, wherein the phase shift circuit is located in the strip line cavity, wherein P first PCBs in the N first PCBs are located on an outer surface of the strip line cavity, wherein P is an integer, and wherein 1≤P≤N, wherein all or a portion of the M antenna radiation units are connected to the N first PCBs, and wherein the N first PCBs are connected to the phase shift circuit.

2. The base station according to claim 1, wherein the phase shift circuit is integrated into a second PCB or a sheet metal strip line.

3. The base station according to claim 1, wherein one or more of the M antenna radiation units are connected to a signal plane of one of the N first PCBs.

4. The base station according to claim 1, wherein reflective surfaces of the M antenna radiation units are a strip line ground plane and/or the outer surface of the strip line cavity.

5. The base station according to claim 1, wherein the M antenna radiation units form one or more linear array antenna systems.

6. The base station according to claim 5, wherein the array antenna system comprises a plurality of strip line cavities when the M antenna radiation units form a plurality of linear array antenna systems corresponding to the plurality of strip line cavities, respectively.

7. The base station according to claim 6, wherein upper surfaces of two strip line cavities corresponding to two adjacent linear array antenna systems in the plurality of linear array antenna systems are continuous.

8. The base station according to claim 1, wherein the M antenna radiation units comprise antenna radiation units at different frequency bands.

9. The base station according to claim 1, wherein a ground plane of one of the N first PCBs is a strip line ground plane.

10. The base station according to claim 1, wherein the P first PCBs are installed on the outer surface of the strip line cavity in a partly overlapped manner; or, the P first PCBs are respectively installed on an upper surface of the strip line cavity and a side surface of the strip line cavity; or, the P first PCBs are installed on one outer surface of the strip line cavity.

11. The base station according to claim 1, wherein a signal plane of each of the P first PCBs is connected to the phase shift circuit by one or more probes.

12. The base station according to claim 1, wherein the N first PCBs are configured to implement the power allocation function and the phase compensation function, wherein the N first PCBs comprise a PCB integrating a power allocation circuit and a phase compensation circuit, and wherein an output end of the power allocation circuit is connected to an input end of the phase compensation circuit.

13. An array antenna system comprising:

M antenna radiation units; and a strip line feed system, wherein the strip line feed system comprises a strip line cavity, a phase shift circuit and N first printed circuit boards (PCBs) configured to implement a power allocation function and/or a phase compensation function, wherein M is an integer greater than 1, wherein N is an integer greater than or equal to 1, and wherein N≤M, wherein the phase shift circuit is located in the strip line cavity, wherein P first PCBs in the N first PCBs are located on an outer surface of the strip line cavity, wherein P is an integer, and wherein 1≤P≤N, wherein all or a portion of the M antenna radiation units are connected to the N first PCBs, and wherein the N first PCBs are connected to the phase shift circuit.

14. The array antenna system according to claim 13, wherein the phase shift circuit is integrated into a second PCB or a sheet metal strip line.

15. The array antenna system according to claim 13, wherein one or more of the M antenna radiation units are connected to a signal plane of one of the N first PCBs.

16. The array antenna system according to claim 13, wherein the M antenna radiation units form one or more linear array antenna systems.

17. The array antenna system according to claim 16, wherein the array antenna system comprises a plurality of strip line cavities when the M antenna radiation units form a plurality of linear array antenna systems, wherein each of the plurality of linear array antenna systems corresponds to one strip line cavity, and wherein upper surfaces of two strip line cavities corresponding to two adjacent linear array antenna systems in the plurality of linear array antenna systems are continuous.

18. The array antenna system according to claim 13, wherein a ground plane of one of the first PCBs is a strip line ground plane.

19. The array antenna system according to claim 13, wherein the P first PCBs are installed on the outer surface of the strip line cavity in a partly overlapped manner; or, the P first PCBs are respectively installed on an upper surface of the strip line cavity and a side surface of the strip line cavity; or, the P first PCBs are installed on one outer surface of the strip line cavity.

20. The array antenna system according to claim 13, wherein a signal plane of each of the P first PCBs is connected to the phase shift circuit by one or more probes.

* * * * *